US010347109B2

(12) United States Patent
Troy et al.

(10) Patent No.: US 10,347,109 B2
(45) Date of Patent: Jul. 9, 2019

(54) AUTOMATED HUMAN PERSONNEL FALL ARRESTING SYSTEM AND METHOD

(71) Applicant: The Boeing Company, Chicago, IL (US)

(72) Inventors: James J. Troy, Issaquah, WA (US); Gary E. Georgeson, Tacoma, WA (US); Scott W. Lea, Renton, WA (US); Daniel J. Wright, Mercer Island, WA (US); Karl E. Nelson, Shoreline, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/346,154

(22) Filed: Nov. 8, 2016

(65) Prior Publication Data

US 2018/0126198 A1 May 10, 2018

(51) Int. Cl.

| | |
|---|---|
| ***G08B 21/04*** | (2006.01) |
| ***A62B 35/00*** | (2006.01) |
| ***B66C 15/06*** | (2006.01) |
| ***B66F 11/04*** | (2006.01) |
| ***B66F 17/00*** | (2006.01) |

(52) U.S. Cl.

CPC ..... *G08B 21/0446* (2013.01); *A62B 35/0068* (2013.01); *A62B 35/0093* (2013.01); *B66C 15/06* (2013.01); *B66F 11/044* (2013.01); *B66F 17/00* (2013.01); *A62B 35/0006* (2013.01)

(58) Field of Classification Search

CPC . E04G 21/3238; E04G 5/001; A62B 35/0043; A62B 35/0006; A62B 35/005; G08B 21/0446; G05D 1/00; G05D 1/02; B66F 11/04

See application file for complete search history.

(56) References Cited

U.S. PATENT DOCUMENTS

| | | | | | |
|---|---|---|---|---|---|
| 4,440,261 | A * | 4/1984 | Clark | A62B 1/06 | 182/142 |
| 4,529,063 | A * | 7/1985 | Kishi | B66F 11/04 | 182/141 |
| 4,607,724 | A * | 8/1986 | Hillberg | A62B 35/04 | 182/3 |
| 5,271,482 | A * | 12/1993 | Walz | B66F 11/04 | 182/148 |

(Continued)

*Primary Examiner* — Katherine W Mitchell
*Assistant Examiner* — Shiref M Mekhaeil
(74) *Attorney, Agent, or Firm* — Perman & Green, LLP

(57) ABSTRACT

An automated human personnel fall arresting system including a holonomic base platform, a boom arm movably mounted to and depending from the base platform, at least a portion of the arm being movable in three degrees-of-freedom relative to the base platform, a tether supported by the arm, an operator harness coupled to the tether so as to be dependent from the arm, at least one sensor disposed on the arm and configured to sense movement of the portion of the arm in two degrees-of-freedom of the three degrees-of-freedom, and a controller mounted to the base platform and communicably coupled to the at least one sensor, the controller being configured to automatically control position of the base platform in two orthogonal translational directions and one rotation direction controlled independently from translation, relative to the operator harness, based on signals from the at least one sensor.

20 Claims, 10 Drawing Sheets

(56) References Cited

U.S. PATENT DOCUMENTS 6,128,782 A * 10/2000 Young ..... A41D 13/0007 182/3
6,174,124 B1 * 1/2001 Haverfield ..... B66F 9/06 182/148
7,194,358 B2 3/2007 Callaghan et al.
7,643,893 B2 1/2010 Troy et al.
8,713,998 B2 5/2014 Troy et al.
8,738,226 B2 5/2014 Troy et al.
9,010,684 B2 4/2015 Motzer et al.
9,043,146 B2 5/2015 Troy et al.
9,197,810 B2 11/2015 Troy et al.
9,234,904 B2 1/2016 Troy et al.
9,410,659 B2 8/2016 Troy et al.
9,623,270 B2 * 4/2017 Palet ..... A62B 35/0068
9,701,525 B1 * 7/2017 Cui ..... B66F 11/04
2005/0169735 A1 * 8/2005 Pelsue ..... A62B 1/04 414/469
2007/0132634 A1 * 6/2007 Wakeman ..... G01S 7/4026 342/174
2010/0126801 A1 * 5/2010 Begin ..... A62B 35/0056 182/3
2012/0043158 A1 * 2/2012 Campbell ..... B66F 11/04 182/69.4
2012/0193165 A1 * 8/2012 Vetesnik ..... A62B 35/0068 182/3
2012/0320372 A1 * 12/2012 Troy ..... G01N 29/043 356/237.2
2013/0313396 A1 * 11/2013 Vetesnik ..... E04H 12/2269 248/523
2014/0076659 A1 * 3/2014 Terry ..... A47L 3/02 182/13
2014/0090927 A1 * 4/2014 Patton ..... A62B 35/0068 182/112
2014/0210997 A1 * 7/2014 Blanchard ..... G01M 5/0016 348/128
2014/0278221 A1 9/2014 Troy et al.
2014/0332317 A1 * 11/2014 Campbell ..... B66F 11/04 182/141
2015/0027808 A1 * 1/2015 Baillargeon ..... B66F 17/006 182/3
2015/0226369 A1 * 8/2015 Troy ..... F16M 11/18 180/2.1
2015/0290517 A1 * 10/2015 Saleh ..... A63B 69/12 434/254
2016/0240298 A1 * 8/2016 Troy ..... H01F 7/0257
2016/0257543 A1 * 9/2016 Hufnagl ..... B66F 11/044
2017/0131720 A1 * 5/2017 Sullivan ..... G05D 1/0272
2017/0225018 A1 * 8/2017 Palet ..... A62B 35/0068

* cited by examiner

AUTOMATED HUMAN PERSONNEL FALL ARRESTING SYSTEM AND METHOD

BACKGROUND

1. Field

The present disclosure generally relates to fall arresting systems and in particular to mobile human personnel fall arresting systems.

2. Brief Description of Related Developments

Generally, conventional personnel fall arresting systems are provided as portable and unportable systems. As one example portable systems may be constructed for use and dismantled for transport. As another example portable systems may be trailerable (i.e. can be attached to a vehicle and towed from one job site to another job site). Some portable systems may also include casters so that the portable system may be manually pushed around a job site. The portable systems, in one aspect include a horizontal extension that is supported by a vertical stanchion where personnel are tethered to the horizontal extension. In another aspect, the portable systems may include a rail supported by one or more horizontal extensions where personnel are tethered to a sliding member of the rail and are allowed to traverse a path defined by the rail. The unportable systems are generally much larger than the portable systems and include horizontal rails supported by vertical stanchions. The horizontal rails may extend over large areas (in a manner similar to that of a gantry crane) and may be positioned at heights unsuited for the portable systems. With the unportable fall arresting systems personnel are tethered to the horizontal rail and are allowed to traverse along a path defined by the rail. Generally, with these conventional personnel fall arresting systems, the person tethered thereto is only allowed to travel within the limited distance provided by the structure of the fall arresting system. If the personnel tethered to a conventional fall arresting system is to work outside the area delimited by the fall arresting system, the person must disconnect from the fall arresting system and reconnect to a different fall arresting system in the desired work area or, in the case of portable system, the fall arresting system must be moved to the desired work area.

To provide personal movement the conventional personal fall arresting systems generally require a predetermined amount of cable payout or slack. This predetermined amount of cable payout or slack in the cable may allow the person tethered to the cable to swing or fall further than desired, such as when the conventional fall arrest systems are operating to arrest a fall.

In other aspects, safety nets, air bags and other complaint elements on the ground may be provided in addition to or in lieu of the conventional fall arresting systems but again, use of these compliant elements may be cumbersome and occupy additional space on the ground. Wearable airbags that inflate as a person falls are another conventional option for fall protection, however these wearable airbags may be heavy and cumbersome to wear.

SUMMARY

The following is a non-exhaustive list of examples, which may or may not be claimed, of the subject matter according to the present disclosure.

One example of the subject matter according to the present disclosure relates to an automated human personnel fall arresting system comprising a holonomic base platform, a boom arm movably mounted to and depending from the holonomic base platform, at least a portion of the boom arm being movable in three degrees-of-freedom relative to the holonomic base platform, a tether supported by the boom arm, an operator harness coupled to the tether so as to be dependent from the boom arm, at least one sensor disposed on the boom arm and configured to sense movement of the portion of the boom arm in two degrees-of-freedom of the three degrees-of-freedom of the boom arm, and a controller mounted to the holonomic base platform and communicably coupled to the at least one sensor, the controller being configured to automatically control a position of the holonomic base platform in two orthogonal translational directions and one rotation direction controlled independently from translation, relative to the operator harness, based on signals from the at least one sensor.

Another example of the subject matter according to the present disclosure relates to an automated human personnel fall arresting system comprising a holonomic base platform;

an extendable mast having a first end and a second end, an arm member having a first end and a second end, the first end of the arm member being coupled to the second end of the extendable mast so that at least a portion of the arm member is movable relative to the holonomic base platform in two degrees-of-freedom, the first end of the extendable mast being coupled to the holonomic base so as to extend and retract the arm member relative to the holonomic base platform in an extension direction, a tether supported by the arm member, an operator harness coupled to the tether so as to be dependent from the arm member, at least one sensor disposed on one or more of the extendable mast and the arm member, the at least one sensor being configured to sense movement of the arm member in the two degrees-of-freedom, and a controller mounted to the holonomic base platform and communicably coupled to the at least one sensor, the controller being configured to automatically control a position of the holonomic base platform in two orthogonal translational directions and one rotation direction controlled independently from translation, relative to the operator harness, based on signals from the at least one sensor.

Still another example of the subject matter according to the present disclosure relates to an automated human personnel fall arresting method comprising sensing, with at least one sensor, movement of an arm member in two degrees-of-freedom relative to a holonomic base platform to which the arm member is mounted through an extendable mast, and automatically controlling a position and orientation of the holonomic base platform in two orthogonal translational directions and one rotation direction controlled independently from translation, relative to an operator harness tethered to the arm member, with a controller mounted to the holonomic base platform based on signals from the at least one sensor.

BRIEF DESCRIPTION OF THE DRAWINGS

Having thus described examples of the present disclosure in general terms, reference will now be made to the accompanying drawings, which are not necessarily drawn to scale, and wherein like reference characters designate the same or similar parts throughout the several views, and wherein:

FIG. 1 (inclusive of FIGS. 1A and 1B) is a schematic block diagram of an automated human personnel fall arresting system in accordance with aspects the present disclosure;

FIG. 2A is a schematic side view illustration of a portion of the automated human personnel fall arresting system in accordance with aspects of the present disclosure;

FIG. 2B is a schematic top view illustration of a portion of the automated human personnel fall arresting system in accordance with aspects of the present disclosure;

FIG. 3 is a schematic side view illustration of a portion of the automated human personnel fall arresting system in accordance with aspects of the present disclosure;

FIG. 3A is a schematic top view illustration of a portion of the automated human personnel fall arresting system in accordance with aspects of the present disclosure;

FIG. 4A is a schematic side view illustration of a portion of the automated human personnel fall arresting system in accordance with aspects of the present disclosure;

FIG. 4B is a schematic top view illustration of a portion of the automated human personnel fall arresting system in accordance with aspects of the present disclosure;

FIG. 5 is a schematic side view illustration of a portion of the automated human personnel fall arresting system in accordance with aspects of the present disclosure;

FIG. 6A is a schematic side view illustration of a portion of the automated human personnel fall arresting system in accordance with aspects of the present disclosure;

FIG. 6B is a schematic front view illustration of a portion of the automated human personnel fall arresting system in accordance with aspects of the present disclosure;

FIG. 6C is a schematic top view illustration of a portion of the automated human personnel fall arresting system in accordance with aspects of the present disclosure;

Figure 7:
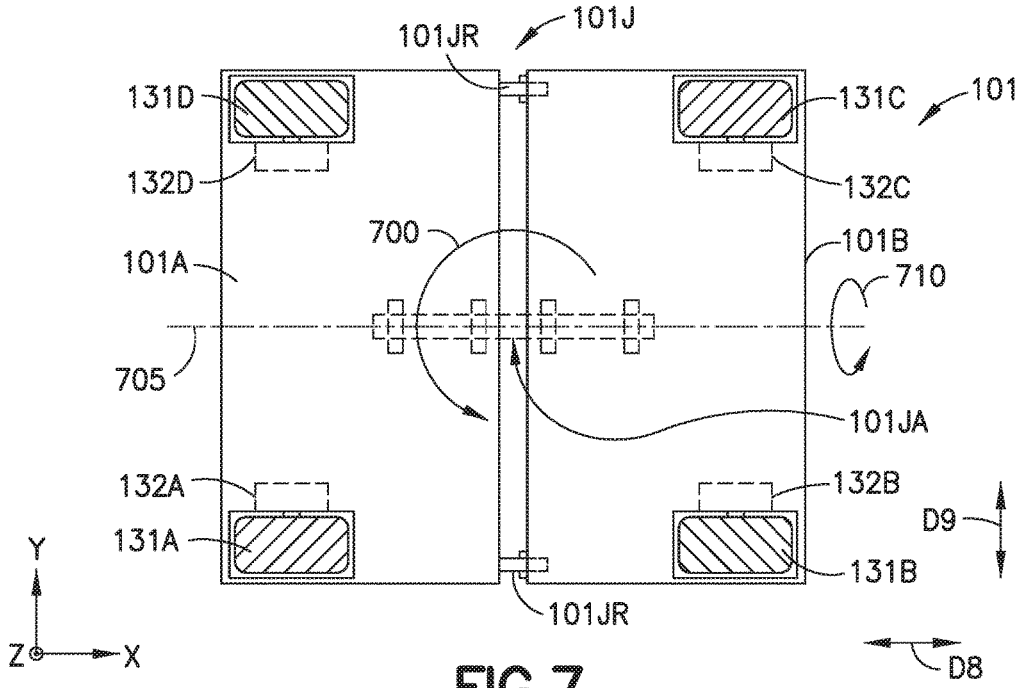
Figure 8:
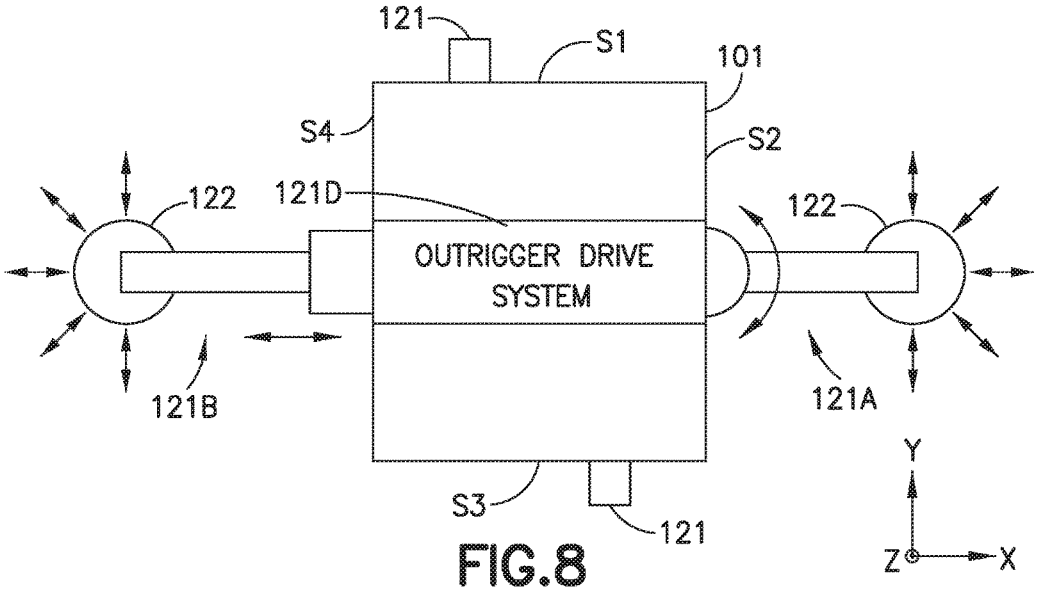
Figure 9:
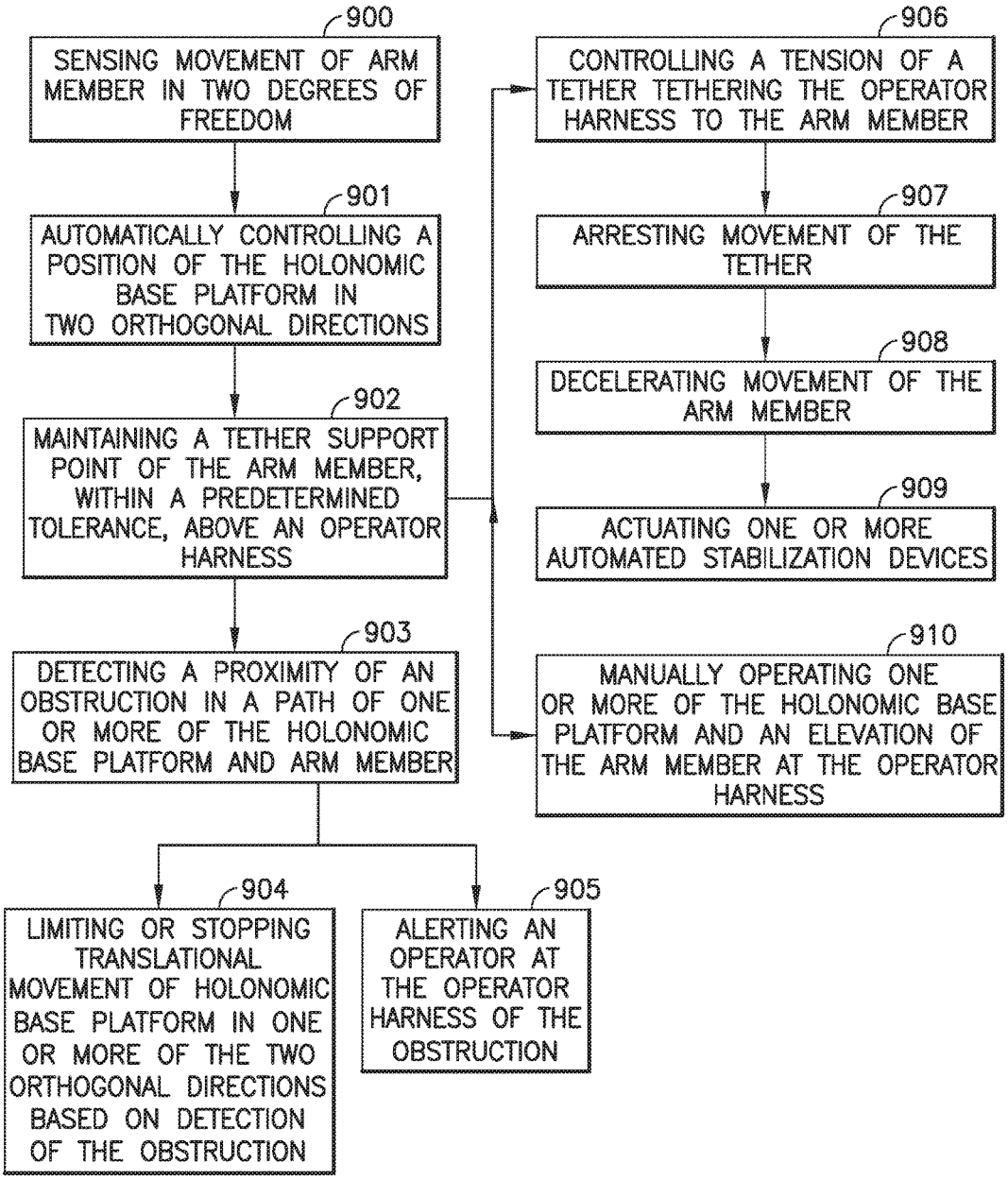

FIG. 7 is a schematic illustration of a portion of the automated human personnel fall arresting system drive system and articulating holonomic base platform in accordance with aspects of the present disclosure;

FIG. 8 is a schematic top view illustration of a portion of the automated human personnel fall arresting system in accordance with aspects of the present disclosure; and FIG. 9 is an exemplary flow diagram in accordance with aspects of the present disclosure;

DETAILED DESCRIPTION

Figures 1, 1A, 1B:
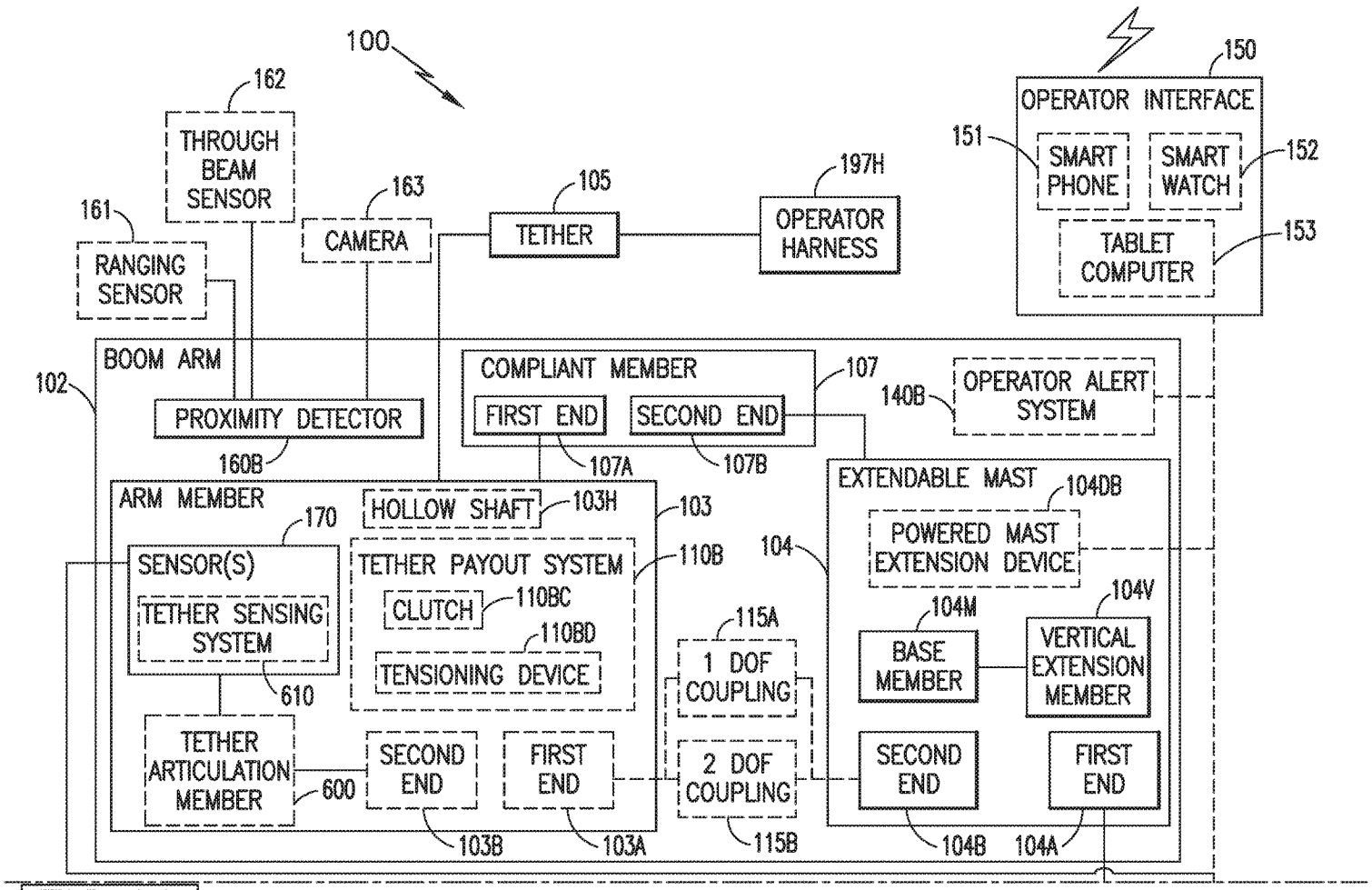
Figure 1B:
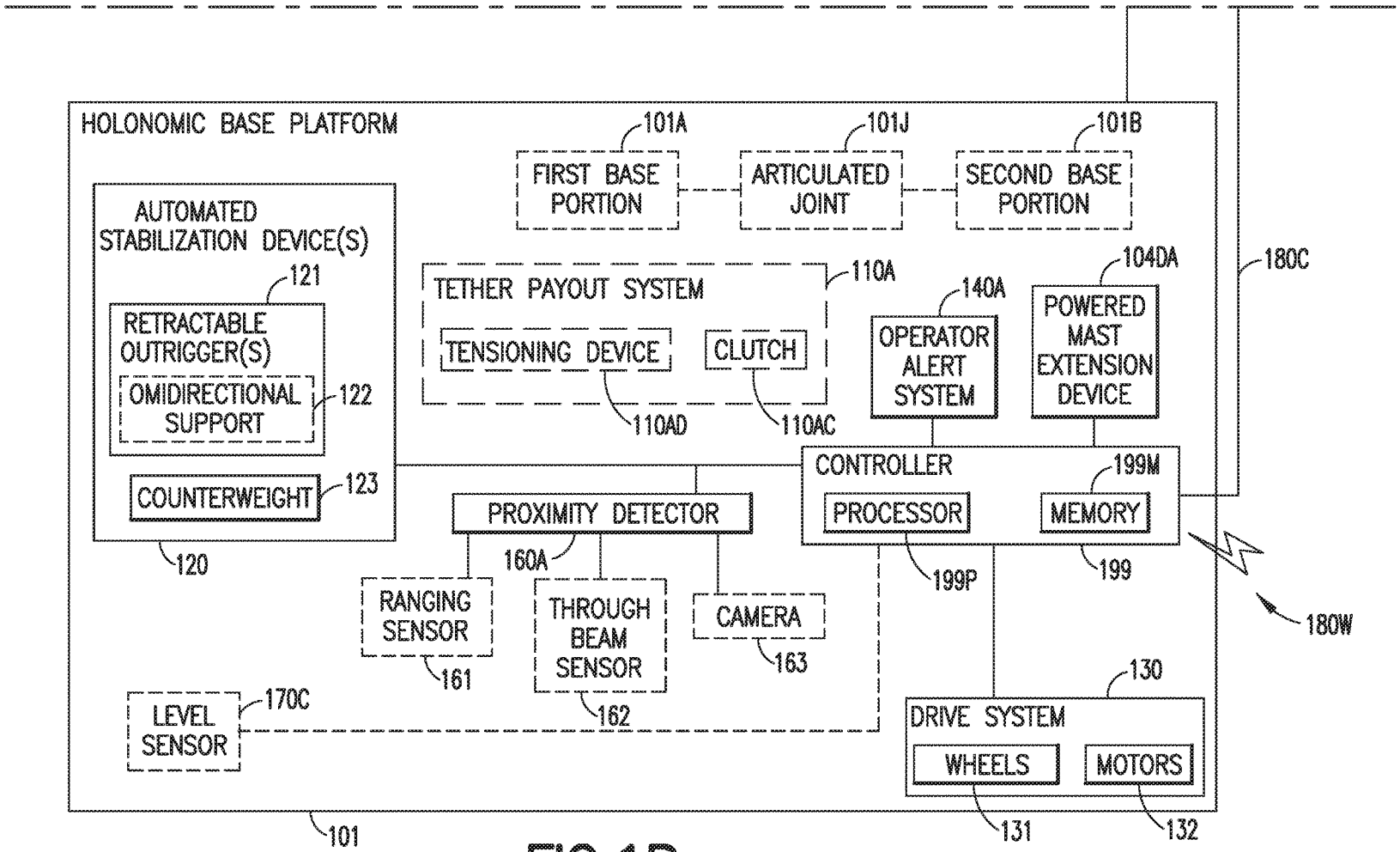
Figure 2A:
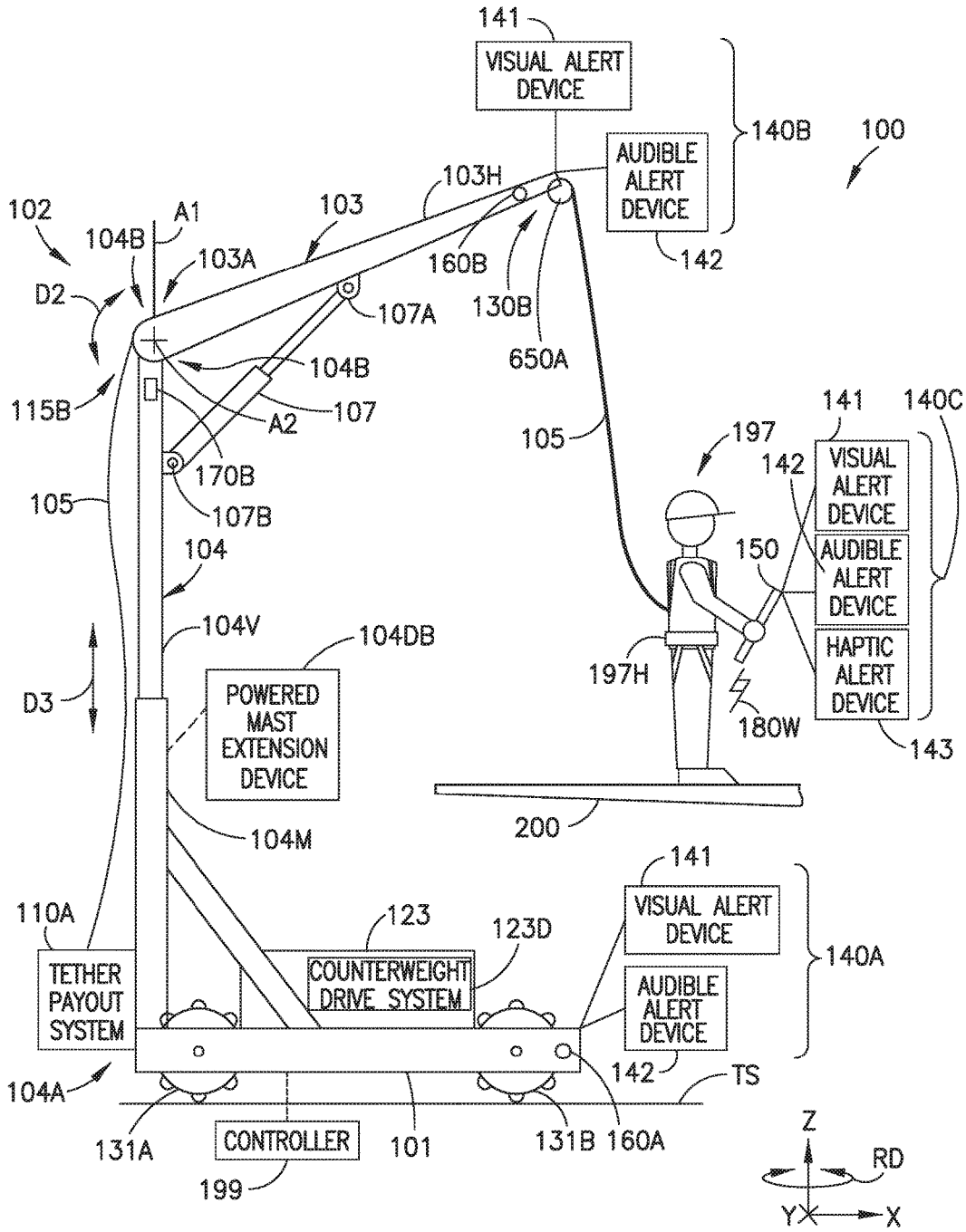
Figure 2B:
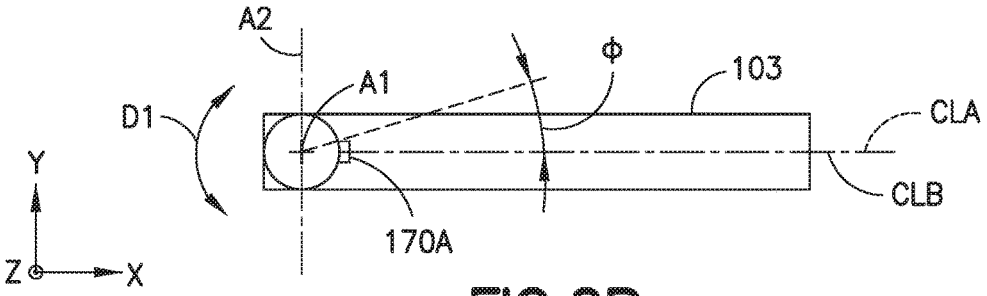

Referring to FIG. 1, the automated human personnel fall arresting system 100 (referred to herein as the "system 100") addresses the problems with the conventional personnel fall arresting systems and provides automated and reactive fall protection for a human operator 197 (see e.g. FIG. 2A). The system 100 is transportable and can be used in a factory, a depot or in a field environment. The system 100 may be rapidly deployed for use provides the human operator 197 with unrestricted freedom of movement within an activity space (e.g. work area) when the human operator 197 is tethered to the system 100. The system 100 provides the benefits of an unportable fall arrest system (e.g. decreased fall distance, prevention of downtime and ease of use), but without the cost, extended footprint, or permanence associated with an unportable fall protection system. In one aspect, the system 100 meets or exceeds government and industry standards for human fall protection where such standards include, at least Occupational Safety and Health Administration (OSHA) Fall Protection Code 1910.66 App C (United States Federal Law) and American National Standards Institute (ANSI) Fall Protection Code Z359 (United States Nationally Recognized Safety Standard).

The system 100 also provides for automatic position adjustment of the system 100, in at least two degrees-of-freedom, depending on translational movements of the human operator 197 tethered to the system. The system 100 follows the human operator 197 with an overhead arm member 103 that does not require an external positioning system to follow the movement of the human operator 197. The ability of the system 100 to follow the movement of the human operator 197 without additional ground equipment or ground personnel monitoring the movement of the human operator 197 and/or system 100 may allow freedom of human operator 197 movement over large areas and around objects having complex shapes, such as aircraft or other irregularly shaped objects.

Referring now to FIGS. 1-7, the system 100 includes a holonomic base platform 101 and a boom arm 102 movably mounted to and depending from the holonomic base platform 101. In some aspects, at least a portion 102P of the boom arm 102 is movable in three degrees-of-freedom relative to the holonomic base platform 101. For example, the boom arm 102 includes an extendable mast 104 and an arm member 103.

The extendable mast 104 includes a base member 104M and a vertical extension member 104V. The base member 104M is coupled (e.g. such as by being immovably fixed) to the holonomic base platform 101 (e.g. base member 104M is fixed in both translation and rotation relative to the holonomic base platform 101) at a first end 104A of the extendable mast 104, and the arm member 103 is movably coupled to a second end 104B of the extendable mast 104 at a first end 130A of the arm member 103. A vertical extension member 104V that is rotationally fixed to the base member 104M. The vertical extension member 104V is movably coupled to the base member 104M so as to extend and retract relative to the base member 104M in direction D3 along the Z-axis (vertical axis). For example, the vertical extension member 104V is moveable relative to the base member 104M in direction D3 along the Z-axis. The arm member 103 is coupled to the vertical extension member 104V so that the arm member is provided with substantially vertical movement along the Z-axis. In some aspects the coupling of the arm member 103 with the vertical extension member 104 (e.g. the extendable mast 104) provides the arm member 103 with rotational movement about the Z-axis and rotational movement about the Y-axis (see e.g. FIGS. 1, 2A and 4A). In other aspects a portion of the arm member 103 may be provided with rotational movement about the X-axis and rotational movement about the Y-axis (see e.g. FIGS. 1, 3, 5 and 6A-6B). A powered mast extension device 104DA (see e.g. FIGS. 1 and 3) that is configured to extend and retract the vertical extension member 104V may be located on the holonomic base platform 101 or on the extendable mast 104 to drivingly move the vertical extension member 104V in direction D3. In other aspects, a powered mast extension device 104DB (see e.g. FIGS. 1 and 2A), similar to powered mast extension device 104DA, may be located on the extendable mast 104 to drivingly move the vertical extension member 104V in direction D3. The powered mast extension device 104DA, 104DB may be a screw drive, a gear drive, a belt/pulley drive, a hydraulic drive, a pneumatic drive or any other suitable drive configured to move the vertical extension member 104V relative to the base member 104M. The controller 199 is configured to actuate the powered mast extension device 104DA, 104DB based on, for example, operator input and/or based on feedback from one or more sensors 170 coupled to the arm member 103.

A tether 105 is supported by the boom arm 102 and an operator harness 197H is coupled the tether 105 so as to be dependent from the boom arm 102. At least one sensor 170 is disposed on the boom arm 102 and is configured to sense movement of the portion of the boom arm 102 in two degrees-of-freedom of the three degrees-off-freedom of the boom arm 102. For example, the at least one sensor 170 is disposed on the boom arm 102 to sense one or more of the rotational movement about the Z-axis, the rotational movement about the Y-axis, and the rotational movement about the X-axis. A controller 199 is coupled to the holonomic base platform 101 so as to be carried by the holonomic base platform 101. The controller 199 is communicably coupled to the at least one sensor 170 and is configured to automatically control a position of the holonomic base platform 101 along a travel surface TS in two orthogonal translational directions D8, D9 (see FIG. 7, e.g. along the X and Y axes) and in one rotation direction (e.g. about the Z-axis—see FIGS. 2A, 3, 4A and 6C) controlled independently from translation in the two orthogonal direction, relative to the operator harness 197H tethered to the boom arm 102, based on signals from the at least one sensor 170. The controller 199 includes a memory 199M and a processor 199P where the memory 199M includes and the processor 199P is configured to suitable non-transitory program code for carrying out the movements and functions of the system 100 described herein.

In one aspect, the movement of the holonomic base platform 101 is provided by drive system 130 of the holonomic base platform 101. The drive system 130 is coupled to the controller 199 and includes drive wheels 131 and motors 132. In one aspect, as illustrated in FIG. 7, there are four drive wheels 131A-131D where each drive wheel 131A-131D has a respective drive motor 132A-132D. Here the drive wheels 131A, 131C are type A Mecanum wheels while drive wheels 131B, 131D are type B Mecanum wheels, where the type A Mecanum wheels 131A, 131C differ from the type B Mecanum wheels 131B, 131D in that tapered rollers of the Type A wheels 131A, 131C (illustrated as diagonal lines on the wheels in FIG. 7) are oriented at different angles than the tapered rollers of the Type B wheels 131B, 131D. A Mecanum wheeled vehicle can be made to move in any direction along the plane of the travel surface TS and rotate on the travel surface TS by controlling the speed and direction of rotation of each wheel individually. For example, rotating all four wheels in the same direction at the same speed causes forward or backward movement (i.e. movement in one of the two orthogonal directions); rotating the Type "A" wheels at the same rate but in the opposite direction of the rotation of the Type "B" wheels causes sideways movement (i.e. movement in the other one of the two orthogonal directions); and rotating the wheels on one side at the same speed but in a direction opposite that of the rotation by the wheels on the other side causes the vehicle to rotate (independent of translation in the two orthogonal directions).

Referring now to FIGS. 1-2A and 4A-4B, in one aspect, the arm member 103 is rotatably coupled to the second end 104B of the extendable mast 104 at a two degree-of-freedom coupling 115B in both pitch (about axis A2) and in yaw (about axis A1). In one aspect, the arm member 103 may be a telescopic arm member having a base member 103M and an extension member 103E that is extendable in direction D7 relative to the base member 103M. In other aspects, the arm member 103 is not extendable in direction D7. The at least one sensor 170 is configured to sense a yaw angle $\phi$ of the arm member 103 in direction D1 about axis A1 relative to the holonomic base platform 101 and a pitch angle $\theta$ of the arm member 103 in direction D2 about axis A2 relative to the holonomic base platform 101. In one aspect, the at least one sensor includes a rotation sensor 170A disposed on one or more of the extendable mast 104 and arm member 103. For example, the rotation sensor 170A may be any suitable sensor such as an encoder having an encoder track or disc coupled to the arm member 103 and a track reader coupled to the extendable mast 104, while in other aspects the encoder track is coupled to the extendable mast 104 and the track reader is coupled to the arm member 103. In other aspects, the rotation sensor 170A may be two or more limit switches configured to sense predetermined rotational positions of the arm member 103 in direction D1 with respect to the extendable mast 104 and/or the holonomic base platform 101. In one aspect the at least one sensor 170 also includes a pitch sensor 170B disposed on one or more of the extendable mast 104 and arm member 103. For example, the pitch sensor 170B may be any suitable sensor such as a rotational encoder having an encoder track or disc coupled to the arm member 103 and a track reader coupled to the extendable mast 104, while in other aspects the encoder track is coupled to the extendable mast 104 and the track reader is coupled to the arm member 103. In other aspects, the pitch sensor 170B may two or more limit switches configured to sense predetermined pitch angles of the arm member 103 in direction D2 with respect to the extendable mast 104 and/or the holonomic base platform 101. The rotation sensor 170A and the pitch sensor 170B are coupled to the controller 199 and configured to send the controller 199 signals that embody a position of the arm member 103 so that the controller 199 controls movement of the holonomic base platform 101 and/or extends the extendable mast 104 to maintain a predetermined spatial relationship between the arm member 103 and the operator harness 197H as described herein. In one aspect, the controller 199 is configured to correct a position of the system 100 when signals are received from sensors 170A, 170B that indicate about a 5° (in other aspects, the threshold may be more or less than 5°) deviation of the arm member 130 in direction D1 about the Z-axis relative to the longitudinal axis CLB (see FIG. 2B) of the holonomic base platform 101 (e.g. in angle $\phi$ relative to the longitudinal axis CLB of the base or any initial or reference value of the angle $\phi$) and/or about a 5° (in other aspects, the threshold may be more or less than 5°) deviation of the arm member about the Y-axis relative to the horizontal plane (e.g. in angle $\theta$ relative to an initial or reference value of the angle $\theta$).

Figure 3A:
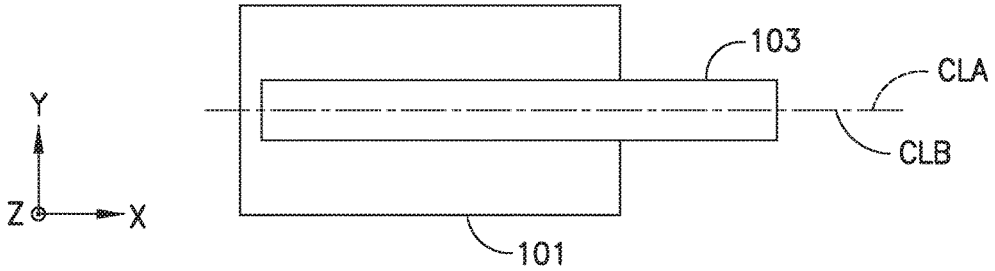
Figure 4B:
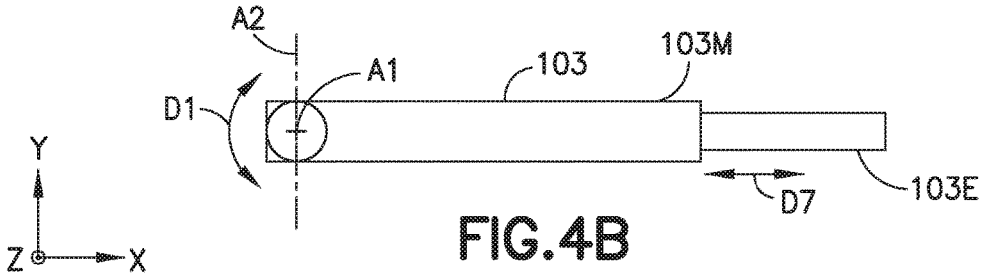
Figure 5:
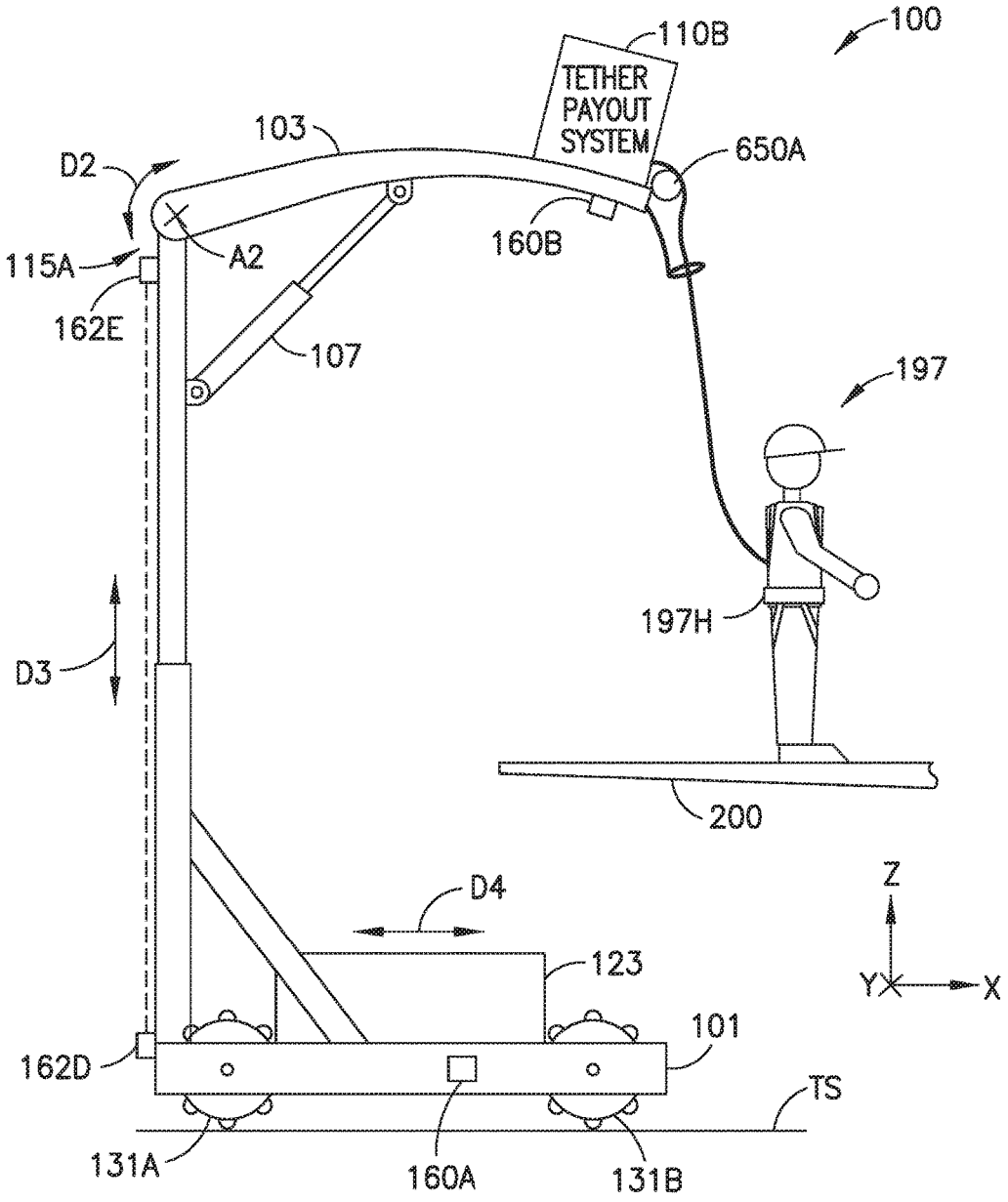
Figure 6B:
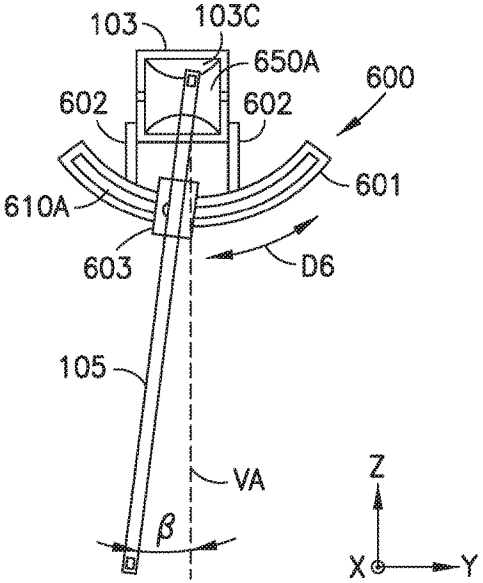
Figure 6A:
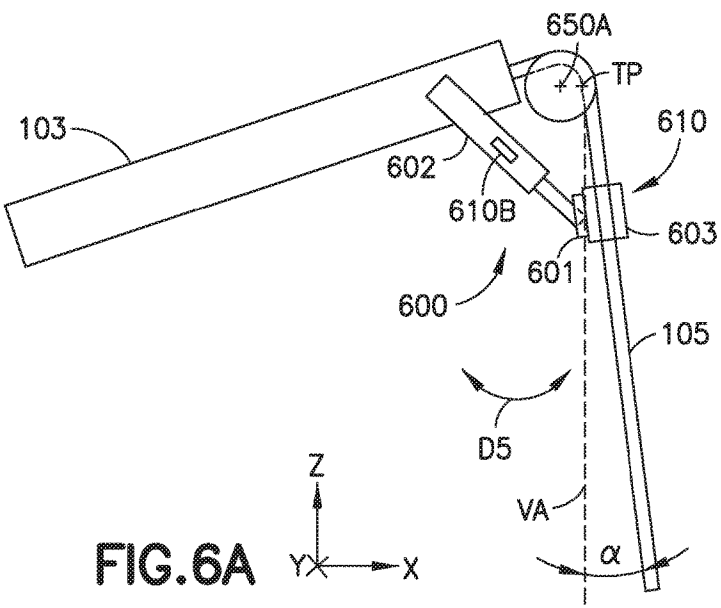
Figure 6C:
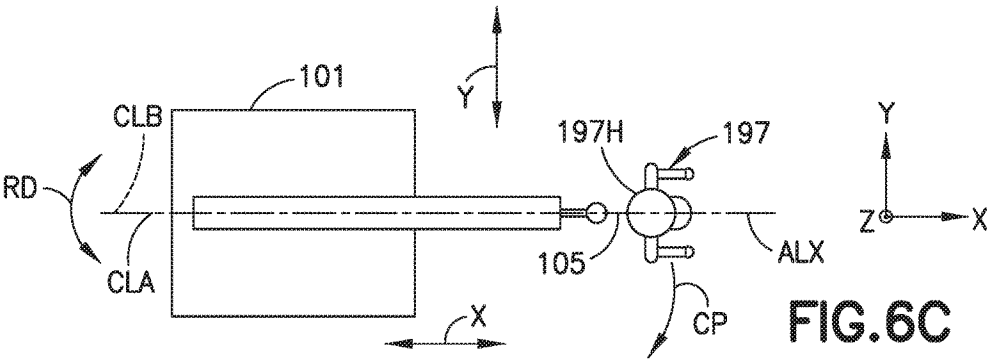

Referring now to FIGS. 1, 3A, 5 and 6A-6B, in one aspect, the arm member 103 is fixed to the extendable mast 104 by a one degree-of-freedom coupling 115A so that the first end 130A of the arm member 103 does not move relative to the extendable mast 104 about the Z-axis. For example, in this aspect, the arm member 103 is non-rotatably fixed to the extendable mast 104 about the Z-axis so that a longitudinal axis CLA of the arm member 103 is substantially coincident with, for example, a longitudinal axis CLB of the holonomic base platform 101 as illustrated in FIG. 3A or any other suitable reference axis. The arm member 103 is also held fixed relative to the extendable mast 104 by, for example, compliant member 107 so that an angle of the arm member 103 (e.g. a line extending from the connection between the extendable mast 104 and the arm member 103 at the first end 103A of the arm member 103 and a tether support pulley 650A at the second end of the arm member 103) is fixed in at known angle θ relative to the extendable mast 104 and/or the holonomic base platform 101, where in one aspect the angle θ is zero and the arm member 103 is substantially parallel with the holonomic base platform 101 (and travel surface TS). In other aspects the angle θ may be any suitable angle. It is noted that, as described herein, the compliant member provides for a predetermined amount of rotation of the arm member 103 about the Y-Axis, at the one degree-of-freedom coupling 115A, relative to the extendable mast 104 such as when a predetermined pulling force is applied to the second end 103B of the arm member 103. In this aspect, the boom arm further comprises a tether articulation member 600 mounted to the second end 103B of the arm member 103. The tether articulation member 600 is configured for movement in two degrees-of-freedom (of the three degrees-of-freedom) of the boom arm 102. For example, the extension of the extendable mast 104 provides the boom arm 102 with a first degree-of-freedom along the Z-axis, while the tether articulation member 600 provides a portion of the boom arm 102 with rotational movement in direction D5 (e.g. about the Y-axis) and rotational movement in direction D6 (e.g. about the X-axis). In one aspect, the tether articulation member 600 includes a track 601 and a sliding member 603 that is configured for movement along the track 601 in direction D6. The track 601 is mounted to the second end 103B of the arm member 103 in any suitable manner such as by one or more pivot arms 602 where the pivot arms 602 are configured so that the track 601 (and the sliding member riding thereon) pivot in direction D5 relative to a predetermined point on the arm member 103 such as, for example, the pulley 650A. As illustrated in FIGS. 6A and 6B the tether 105 wraps around a portion of the pulley 650A and passes through and is captured by the sliding member 603 so that as the tether 105 moves in directions D5, D6 relative to the pulley 650A the sliding member 603 (and track 601) follows the movement of the tether 105. Angles α, β are defined along a respective one of the X and Y axes between a vertical axis VA (i.e. the Z-axis, as would be obtained with a plumb line hanging from a tangent point TP on the pulley) and the tether 105.

In this aspect, the at least one sensor 170 comprises a tether sensing system 610 coupled to the tether articulation member 600. The tether sensing system 610 is configured to sense the angles α, β of the tether 105 relative to one or more of the holonomic base platform 101 and the arm member 103 in the two degrees-of-freedom (e.g. directions D5, D6) of the three degrees-of-freedom (e.g. the Z direction and directions D5, D6). The tether sensing system 610 includes any suitable encoder 610A disposed on one or more of the track 601 and sliding member 603 for sensing the rotation (e.g. angle β) of the tether 105 about the X-axis. The tether sensing system 610 also includes any suitable encoder 610B disposed on one or more of the pivot arms 602, arm member 103 and track 601 for sensing the position (which can be converted into angle α using trigonometry) of the tether 105 about the Y-axis. In other aspects, any suitable sensing devices may be used to sense the angles α, β of the tether 105. The sensors 610A, 610B are coupled to the controller 199 and configured to send the controller 199 signals that embody a position of the tether articulation member 600 (and tether 105) so that the controller 199 controls movement of the holonomic base platform 101 and/or extends the extendable mast 104 to maintain a predetermined spatial relationship between the arm member 103 and the operator harness 197H as described herein. In one aspect, the controller 199 is configured to update a position of the system 100 when signals are received from sensors 610A, 610B that indicate about a 5° (in other aspects, the threshold may be more or less than 5°) deviation from the vertical axis VA. In other aspects, an optical tracking system may be provided on the arm member 103 that includes, for example, a camera that tracks movement of the operator harness 197H (such as using reflectors or other object/movement recognition) where the controller 199 is configured to perform suitable optical recognition and moves the holonomic base platform 101 and/or extends the extendable mast 104 based on the detected movement of the operator harness 197H. In one aspect, while the sensors 170A, 170B, 610A, 610B are described herein as movement sensors, in other aspects the sensors may be load cells configured to determine, for example, an amount of force applied to the arm member 103 or sliding member 603.

A compliant member 107, having a first end 107A coupled to the arm member 103 and a second end 107B coupled to the extendable mast 104, is configured to decelerate movement of the arm member 103 in the title direction D2 relative to the extendable mast 104. The compliant member 107 may be any suitable compliant member such as, for example, a pneumatic shock absorber, a hydraulic shock absorber and/or any suitable resilient member including linear and/or torsion springs.

Referring again to FIGS. 1 and 2A, in one aspect, the boom arm 102 comprises a hollow shaft 103H (see FIGS. 2A and 6B) through which the tether 105 passes. For example, the arm member 130 may include a channel 103C extending from the first end 103A to the second end 130B of the arm member 103. The tether 105 extends through the channel 103C so that a portion of the tether 105 extending from the channel 103C at the second end 103B is coupled to the operator harness 197H and the portion of the tether 105 extending from the channel at the first end 103A is coupled to a tether payout system 110A. In one aspect, referring also to FIGS. 4A and 5, the arm member 103 need not include the channel 103C (see FIG. 4A) so that the tether 105 extends along an exterior surface of the arm member 103.

Figure 4A:
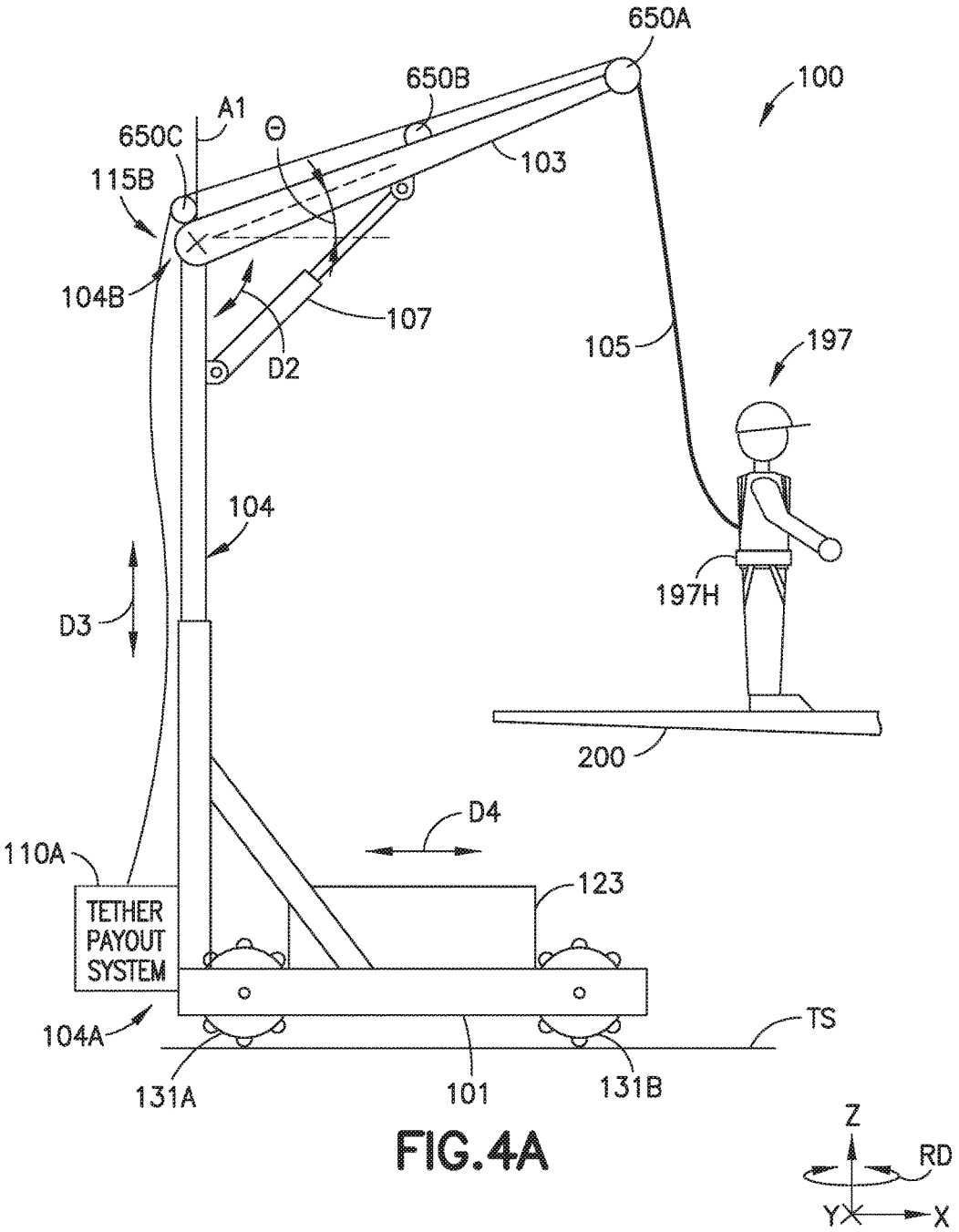

In one aspect, as illustrated in FIGS. 2A and 4A, the tether pay out system 110 may be disposed on the holonomic base platform 101, so that the tether 105 extends from the tether payout system 110A, through the boom arm 103 (e.g. such as through the channel 103C) to the operator harness 197H. In one aspect, the tether payout system 110A includes any suitable tensioning device 110AD configured to control a tension of the tether 105. In one aspect, the tether payout system 110A includes any suitable clutch 110AC configured to arrest movement of the tether 105 upon a predetermined load (e.g. such as the weight of an operator 197) being applied to the tether 105 at the operator harness 197H. Any suitable pulleys 650A-650C are be provided at least at one or more of the first end 103A and the second end 103B of the arm member 103 to guide the tether 105 through the channel 103C and to the tether payout system 110A.

Figure 3:
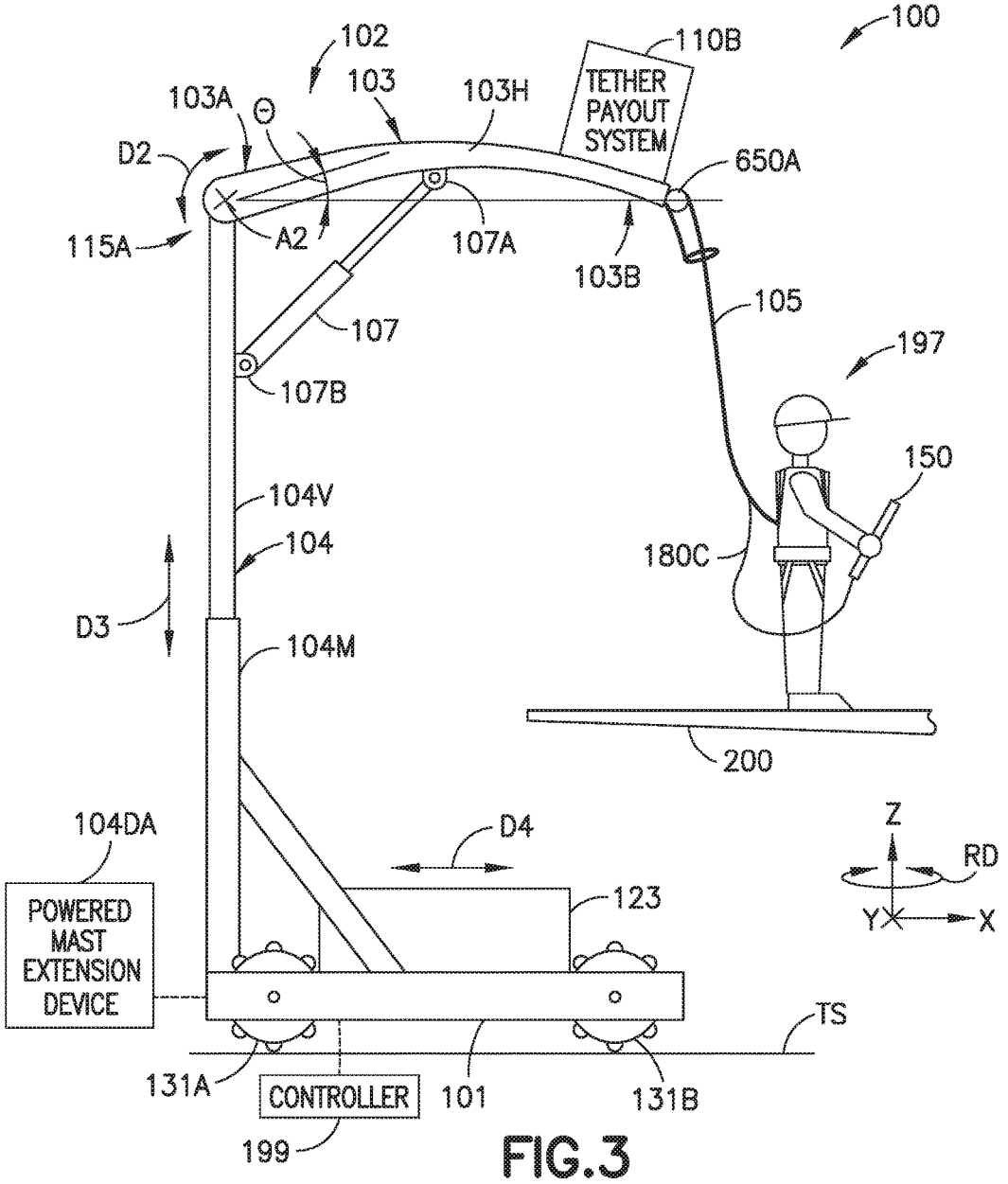

In one aspect, as illustrated in FIGS. 3 and 5 a tether pay out system 110B, that is substantially similar to tether payout system 110A, is disposed on the boom arm 102, rather than on the holonomic base platform 101, so that the tether 105 extends from the tether payout system 110B to the operator harness 197H. In this aspect, as before, the tether payout system 110B includes any suitable tensioning device 110BD (shown in FIG. 1) configured to control a tension of the tether 105. The tether payout system 110B also includes any suitable clutch 110BC configured to arrest movement of the tether 105 upon a predetermined load (e.g. such as the weight of an operator 197) being applied to the tether 105 at the operator harness 197H. Any suitable pulleys 650A-650B are be provided at least at one or more of the first end 103A and the second end 103B of the arm member 103 to guide the tether 105 along the arm member 103 and/or through the channel 103C and to the tether payout system 110A. In one aspect, such as shown in FIGS. 2A, 3, 5 and 6A-6B, where the tether 105 passes through the channel 103C, the channel 103C may form a guide for the tether 105 that maintains the tether 105 on at least pulley 650A (it is noted that other pulleys, similar to pulleys 650B, 650C may be located within the channel 103C for supporting the tether 105 within the channel 103C). In other aspects, such as shown in FIG. 4A, where the tether 105 is routed along an outside of the arm member 103, any suitable guide members may be provided for each pulley 650A-650C so that the tether remains engaged to the pulleys 650A-650C.

Referring to FIGS. 1, 2A and 8 (which illustrates a top view of the holonomic base platform 101), in one aspect, the system 100 includes one or more automated stabilization devices 120 mounted to the holonomic base platform 101. The one or more automated stabilization devices 120 are coupled to the controller 199 where the controller 199 is configured to actuate the one or more automated stabilization devices 120 based on, at least, the signals from the at least one sensor 170. In one aspect, the system 100 includes a level sensor 170C that is configured to sense an orientation of the holonomic base platform 101 relative to, for example, any suitable horizontal reference datum where a signal is sent from the level sensor 170C to the controller 199 upon deviation of holonomic base platform 101 from the horizontal by any suitable predetermined amount. In one aspect, the one or more automated stabilization devices 120 include on or more of a movable counterweight 123 and at least one retractable outrigger 121. The counterweight 123 is movably coupled to the holonomic base platform 101 and may be driven in at least direction D4 along the X-axis and in one aspect, may also be driven along the Y-axis by any suitable counterweight drive system 123D (hydraulic actuators, pneumatic actuators, motorized screw drive actuators, etc.) that is coupled to the controller 199. In one aspect, the at least one retractable outrigger 121 includes at least two retractable outriggers 121A, 121B that in one aspect linearly extend (see retractable outrigger 121B in FIG. 8) from the holonomic base platform 101 while in other aspects, the retractable outriggers rotationally extend from the holonomic base platform 101 (see retractable outrigger 121A in FIG. 8), where at least two opposite sides S2, S4 or S1, S2 and in one aspect, each side S1-S4 of the holonomic base platform 101 has at least one retractable outrigger 121 disposed thereon. In one aspect, the at least one retractable outrigger 121 includes an omnidirectional support 122 (e.g. frictionless pad, omni-wheel, caster, etc.) configured to allow holonomic movement of the holonomic base platform 101 while the at least one retractable outrigger 121 is deployed for stabilizing the system 100. The retractable outriggers 121A, 121B are driven between a retracted and an extended position by any suitable outrigger drive system 121D (hydraulic actuators, pneumatic actuators, screw drive actuators, etc.) coupled to the controller 199.

In one aspect, referring to FIG. 7, the holonomic base platform 101 includes a first base portion 101A, a second base portion 101B and an articulated joint 101J rotatably coupling the first base portion 101A to the second base portion 101B. The articulated joint 101J provides relative movement between the first base portion 101A and the second base portion 101B so that the holonomic base 101 can traverse uneven terrain while maintaining each of the wheels 131A-131D in substantial contact with the travel surface TS. In one aspect, the articulated joint 101J includes a pivot axle 101JA arranged along and defining a roll axis 705 about which each of the first base portion 101A and the second base portion 101B pivot in roll direction 710. The articulated joint 101J may also include any suitable yaw stabilizers 101JR (e.g. such as rollers or sliders) that maintain the first base portion 101A and the second base portion 101B in a predetermined yaw position relative to one another in the yaw direction 700.

Referring now to FIGS. 1, 2A and 3, the system 100 includes an operator interface 150 coupled to the controller 199. The operator interface 150 is configured, through the controller 199, for manual operation of one or more of the holonomic base platform 101 and the boom arm 102 at the operator harness 197H. An operator 197 harnessed in the operator harness 197 may, through the operator interface 150, control, for example, holonomic movement of the holonomic base platform 101, the vertical extension of the extendable mast 104, deployment of the automated stabilization devices 120, and/or horizontal extension of the arm member 103. In one aspect, the operator interface 150 is wirelessly coupled to the controller 199 through any suitable wireless communication system 180W, while in other aspects the operator interface 150 is wired to the controller 199 in any suitable manner such as through wired communication system 180C. In one aspect, the operator interface 150 comprises one or more of a smart phone 151, a tablet computer 153, and/or a smart watch 152. For example, an application may be installed on the smart phone 151, a tablet computer 153, and/or a smart watch 152 that is configured to provide control of the system 100, as described herein through the smart phone 151, a tablet computer 153, and/or a smart watch 152.

In one aspect, the operator interface 150 is configured to receive, from the controller 199, an operational status of the system 100. The operational status of the system 100 may include, for example, one or more of, a system diagnosis check (self-test to note operator alert systems, proximity detectors, etc. are operating), a health of the system components (self-test to note motors, controller, etc. are operating) and a proximity of the system 100 relative to surrounding objects (such as structure 200). On one aspect, the operator 197 may perform a system diagnosis/health check through the operator interface 150 prior to operating the system 100 and address any maintenance that may be required as a result of the system diagnosis/health check. The operator interface 150 may also be coupled, through the controller 199, to one or more operator alert systems 140A, 140B, 140C of the system 100. For example, in one aspect, the system 100 includes at least one proximity detector 160A, 160B coupled to the controller 199 and being mounted to one or more of the holonomic base platform 101 and the boom arm 102. The at least one proximity detector 160A, 160B (shown in FIG. 5) may include one or more of a ranging sensor 161, a through beam sensor 162 (see also FIG. 5 where the through beam sensor has an emitter 162E and a detector 162D where the through-beam is emitted from the emitter 162E and received by the detector 162D) and a camera 163 configured to detect any objects (such as structure 200) within a path or proximity of the system 100. The controller 199 is configured to limit or stop translational movement of the holonomic base platform 101 in one or more of the two orthogonal directions (e.g. movement along the X and/or Y axes) based on signals received from the at least one proximity detector 160A, 160B indicating an object located within a predetermined distance of the system 100. The controller 199, upon receipt of the signal from the at least one proximity detector 160A, 160B may alert the operator 197 at the operator harness 197H an object sensed by the at least one proximity detector 160A, 160B through the one or more operator alert systems 140A, 140B, 140C. In one aspect, the one or more operator alerts systems 140A, 140B, 140C include one or more of a visual alert device 141 (flashing lights, strobes, work/spot lights facing a direction of the obstruction, etc.) and/or an audible alert device (sirens, loud speakers, etc.) disposed on one or more of the boom arm 102 and holonomic base platform 101. In one aspect, the operator interface 150 may include a visual alert device 141 (lights, strobes, etc.), an audible alert device 142 (sirens, loud speakers, etc.) and/or a haptic alert device 143 (e.g. vibratory alerts). The visual alert device 141 (lights, strobes, etc.), the audible alert device (sirens, loud speakers, etc.) and/or the haptic alert device 143 (e.g. vibratory alerts) may be positioned on a respective one of the operator interface 150, the holonomic base platform 101 and the boom arm 102 so that when activated by the controller 199, the visual alert device 141 (lights, strobes, etc.), the audible alert device (sirens, loud speakers, etc.) and/or the haptic alert device 143 (e.g. vibratory alerts) provides the operator 197 at the operator harness 197H an indication of the proximity and direction of the object relative to the system 100.

Referring now to FIGS. 1-9 the system 100 is configured, such as through the controller 199 to automatically control a position of the holonomic base platform 101 in the two orthogonal directions (e.g. the X and Y directions) and in and one rotation direction RD (see FIG. 6C) controlled independently from translation in the two orthogonal directions, relative to the operator harness 197H, based on signals from the at least one sensor 170 so that a tether support point (e.g. a tangent point TP between the tether 105 and pulley 650A) of the boom arm 102 is maintained, within a predetermined tolerance, above the operator harness 197H. In one aspect, in a method of operation of the system 100, movement of the arm member 103 is sensed, with at least one sensor 170, in two degrees-of-freedom (e.g. directions D1, D2 or directions D5, D6) relative to the holonomic base platform 101 to which the arm member 103 is mounted through the extendable mast 104 (FIG. 9, Block 900). The position of the holonomic base platform 101 is automatically controlled in two orthogonal translational directions (e.g. the X and Y directions—see FIG. 6C) and in one rotation direction RD (see FIG. 6C) where the one rotation direction RD is controlled independently from translation in the X and Y directions, relative to the operator harness 197H tethered to the arm member 103, with the controller 199 mounted to the holonomic base platform 101 based on signals from the at least one sensor 170 (FIG. 9, Block 901).

For example, the operator 197 within the operator harness 197H may move such that the operator harness 197H causes movement of the arm member in direction D1 or movement of the sliding member 603 in direction D6. The at least one sensor 170, such as one of sensors 170A, 610A detect the movement of the arm member 103 or sliding member 603 in the respective direction D1, D6 and send a signal to the controller 199 indicating such movement is occurring. The controller 199 controls the individual motors 132 of the drive system 130 so that the wheels 131 operate to move the holonomic base platform 101 in the corresponding direction (in this example, the Y direction) indicated by the sensor 170A, 610A signals. In one aspect, a speed of movement of the holonomic base platform 101 depends on a magnitude of deviation of the longitudinal axis CLA of the arm member 103 from the longitudinal axis CLB of the holonomic base platform 101 or a magnitude of deviation of the tether 105 from the vertical axis VA (e.g. the greater the deviation the faster the holonomic base platform movement will be). As another example, the operator 197 within the operator harness 197H may move such that the operator harness 197H, in one aspect, causes movement of the arm member 103 in direction D2 (see FIGS. 2A and 4A) or, in another aspect, causes movement of the sliding member 603 in direction D5 (see FIGS. 6A and 6B). The at least one sensor 170, such as one of sensors 170B, 610B detects, in one aspect, the movement of the arm member 103 in direction D2 or, in another aspect, detects the movement of the sliding member 603 in direction D5 and send a signal to the controller 199 indicating such movement is occurring. The controller 199 controls the individual motors 132 of the drive system 130 so that the wheels 131 operate to move the holonomic base platform 101 in the corresponding direction (in this example, the X direction) indicated by the sensor 170B, 610B signals. As noted above, the speed of movement of the holonomic base platform 101 may depend on a magnitude of deviation of the arm member 103 angle θ from a predetermined reference datum (such as the horizontal of holonomic base platform) or a magnitude of deviation of the tether 105 from the vertical axis VA (e.g. the greater the deviation the faster the holonomic base platform movement will be).

It should be understood that the movement of the holonomic base platform is not restricted to movement along one axis (e.g. in the X and Y directions) at a time. For example, the controller 199 may control the drive system 130 so that the holonomic base platform moves simultaneously along both the X and Y directions where movement in the X direction is at the same or at a different speed than movement in the Y direction. As noted above, the controller 199 is also configured to move the holonomic base platform in a rotation direction RD independent of movement in the X and Y directions. For example, the operator 197 may cause the operator harness 197H to follow a curved contour or path CP. In this instance the holonomic platform not only has to move in the X and Y directions to maintain the boom arm 102 within the predetermined area above the operator 197 (as defined by the about ±5° movement tolerance described above—again the tolerance may be more or less than about ±5°), the holonomic base platform may also rotate so that the arm member 103 maintains a substantially orthogonal relationship with the curved path CP. For example, the controller 199, based on the sensor signals from the sensors 170A, 170B or the sensors 610A, 610B is configured to determine a path of operator movement (e.g. if the sensors indicate sustained movement in both the X and Y directions the controller may determine a curved path is being followed by the operator 197) and control the drive system 130 so that the holonomic base platform 101 rotates in rotation direction RD so that the operator harness 197 and the longitudinal axis CLA of the arm member 130 (and the longitudinal axis CLB of the holonomic base platform 101) are aligned along an axis of alignment ALX. In the aspects of the present disclosure, the automated controlled movement of the holonomic base platform 101 based on the signals from the sensors 170A, 170B or the sensors 610A, 610B provide the system with self-contained movement tracking (e.g. without intervention from external sensors or input from personnel on the ground) where the position of the holonomic base platform 101 is controlled relative to the operator harness 197H so that a tether support point (e.g. the tangent point TP between the pulley 650A and the tether 105) of the arm member 130 is maintained, within a predetermined tolerance, above the operator harness 197H (FIG. 9, Block 902).

In one aspect, the method of operation of system 100 also includes detecting a proximity of an obstruction (such as structure 200) in a path of one or more of the holonomic base platform 101 or the arm member 103 with at least one proximity detector 160A, 160B (FIG. 9, Block 903). In one aspect, translational movement of the holonomic base platform 101 is limited or stopped in one or more of the two orthogonal directions (e.g. the X and Y directions) based on detection of the obstruction (such as structure 200) (FIG. 9, Block 904). In one aspect, the operator 197 at the operator harness 197H is alerted of the obstruction in the manner described herein, such as through the operator alert system 140A, 140B and/or the operator interface 150 (FIG. 9, Block 905).

In one aspect, the method of operation includes controlling, with the tensioning device 110AD, 110BD of the tether payout system 110A, 110B, a tension of the tether 105 tethering the operator harness 197H to the arm member 103 (FIG. 9, Block 906). In one aspect, the tensioning device 110AD, 110BD includes any suitable force sensor to detect the tension of the tether 105. In one aspect, the tension of the tether 105 may be controlled so that the tension does not limit operator 197 movement (e.g. operator harness 197H movement) relative to the arm member 103 and/or holonomic base platform 101.

In one aspect, where movement of the operator 197 within the operator harness 197H is to be arrested, the method of operation includes arresting movement of the tether 105 (and of the operator harness 197H and operator 197), tethering the operator harness 197H to the arm member 103 upon a predetermined load (such as the weight of the operator 197) being applied to the tether at the operator harness, where the movement is arrested with the clutch 110AC, 110BC of the tether payout system 110A, 110B (FIG. 9, Block 907). In one aspect, the method includes decelerating movement of the arm member 130 (and hence the movement of the operator harness 197 and operator 197), with the compliant member 107, relative to the extendable mast 104 coupling the arm member 103 to the holonomic base platform 101 (FIG. 9, Block 908). In one aspect, method of operation further includes actuating one or more automated stabilization devices 120 coupled to the holonomic base platform 101 based on signals from the at least one sensor 170 (as described herein) (FIG. 9, Block 909). The method of operation may also include manually operating of one or more of the holonomic base platform 101 and an elevation of the arm member 103, at the operator harness 197H, through the controller 199 and with an operator interface 150 coupled to the controller 199 (FIG. 9, Block 910). Movement of the system through the operator interface 150 may allow for initial positioning of the system 150 and manual operator of the system around obstructions.

In one aspect, where there are multiple systems 100 operating in a common area, each of the multiple systems 100 may detect other ones of the systems 100 using the object detection described herein and control themselves accordingly to prevent contact between the systems 100. In other aspects, the respective controllers 199 of the multiple systems 100 may be configured to communicate with one another over, for example, the wireless communication system 180W so that a position of each system 100 is communicated to each other system 100 where each system is configured to maintain a predetermined distance from another system 100.

While the aspects of the present disclosure are described herein with respect to a holonomic boom arm platform it should be understood that the aspects of the present disclosure can be adapted to any suitable operator fall arrest system or operator lift system.

The following are provided in accordance with the aspects of the present disclosure:

A1. An automated human personnel fall arresting system comprising:

a holonomic base platform;

a boom arm movably mounted to and depending from the holonomic base platform, at least a portion of the boom arm being movable in three degrees-of-freedom relative to the holonomic base platform;

a tether supported by the boom arm;

an operator harness coupled to the tether so as to be dependent from the boom arm;

at least one sensor disposed on the boom arm and configured to sense movement of the portion of the boom arm in two degrees-of-freedom of the three degrees-of-freedom of the boom arm; and a controller mounted to the holonomic base platform and communicably coupled to the at least one sensor, the controller being configured to automatically control a position of the holonomic base platform in two orthogonal translational directions and one rotation direction controlled independently from translation, relative to the operator harness, based on signals from the at least one sensor.

A2. The automated human personnel fall arresting system of claim A1, wherein the boom arm comprises a hollow shaft through which the tether passes.

A3. The automated human personnel fall arresting system of claim A2, further comprising a tether pay out system disposed on the holonomic base platform, wherein the tether extends from the tether payout system, through the boom arm to the operator harness.

A4. The automated human personnel fall arresting system of claim A3, wherein the tether payout system includes a tensioning device configured to control a tension of the tether.

A5. The automated human personnel fall arresting system of claim A3, wherein the tether payout system includes a clutch configured to arrest movement of the tether upon a predetermined load being applied to the tether at the operator harness.

A6. The automated human personnel fall arresting system of claim A1, further comprising a tether pay out system disposed on the boom arm, wherein the tether extends from the tether payout system to the operator harness.

A7. The automated human personnel fall arresting system of claim A6, wherein the tether payout system includes a tensioning device configured to control a tension of the tether.

A8. The automated human personnel fall arresting system of claim A7, wherein the tether payout system includes a clutch configured to arrest movement of the tether upon a predetermined load being applied to the tether at the operator harness.

A9. The automated human personnel fall arresting system of claim A1, wherein the boom arm comprises an extendable mast coupled to the holonomic base at a first end of the extendable mast and an arm member movably coupled to a second end of the extendable mast at a first end of the arm member.

A10. The automated human personnel fall arresting system of claim A9, wherein the extendable mast comprises a base member and a vertical extension member movably coupled to the base member so as to extend and retract relative to the base member.

A11. The automated human personnel fall arresting system of claim A10, further comprising a powered mast extension device configured to extend and retract the vertical extension member where the controller is configured to actuate the powered mast extension device based on operator input.

A12. The automated human personnel fall arresting system of claim A9, wherein the arm member is rotatably coupled to the second end of the extendable mast in both pitch and yaw.

A13. The automated human personnel fall arresting system of claim A12, wherein the at least one sensor is configured to sense a yaw angle of the arm member relative to the holonomic base platform and a pitch angle of the arm member relative to the holonomic base platform.

A14. The automated human personnel fall arresting system of claim A9, further comprising a compliant member having a first end coupled to the arm member and a second end coupled to the extendable mast, the compliant member being configured to decelerate movement of the arm member relative to the extendable mast.

A15. The automated human personnel fall arresting system of claim A1, wherein the boom arm comprises an extendable mast coupled to the holonomic base at a first end of the extendable mast and an arm member coupled to a second end of the extendable mast at a first end of the arm member, the arm member being fixed to the extendable mast.

A16. The automated human personnel fall arresting system of claim A15, wherein the boom arm further comprises a tether articulation member mounted to a second end of the arm member, the tether articulation member being configured for movement in the two degrees-of-freedom of the three degrees-of-freedom of the boom arm, and the at least one sensor comprises a tether sensing system coupled to the tether articulation member, the tether sensing system being configured to sense an angle of the tether relative to one or more of the holonomic base platform and the arm member in the two degrees-of-freedom of the three degrees-of-freedom.

A17. The automated human personnel fall arresting system of claim A15, further comprising a compliant member having a first end coupled to the arm member and a second end coupled to the extendable mast, the compliant member being configured to decelerate movement of the arm member relative to the extendable mast.

A18. The automated human personnel fall arresting system of claim A1, further comprising one or more automated stabilization devices mounted to the holonomic base platform, the controller being configured to actuate the one or more automated stabilization devices based on the signals from the at least one sensor.

A19. The automated human personnel fall arresting system of claim A18, wherein the one or more automated stabilization devices includes at least one retractable outrigger.

A20. The automated human personnel fall arresting system of claim A19, wherein the at least one retractable outrigger includes an omnidirectional support.

A21. The automated human personnel fall arresting system of claim A18, wherein the one or more automated stabilization devices includes a counterweight movably mounted to the holonomic base platform.

A22. The automated human personnel fall arresting system of claim A1, wherein the holonomic base platform comprises a first base portion, a second base portion and an articulated joint rotatably coupling the first base portion to the second base portion.

A23. The automated human personnel fall arresting system of claim A1, further comprising an operator interface coupled to the controller, the operator interface being configured, through the controller, for manual operation of one or more of the holonomic base and the boom arm at the operator harness.

A24. The automated human personnel fall arresting system of claim A23, wherein the operator interface is wirelessly coupled to the controller.

A25. The automated human personnel fall arresting system of claim A23, wherein the operator interface is wired to the controller.

A26. The automated human personnel fall arresting system of claim A23, wherein the operator interface comprises one or more of a smart phone, a tablet computer and a smart watch.

A27. The automated human personnel fall arresting system of claim A23, wherein the operator interface is configured to receive, from the controller, an operational status of the automated human personnel fall arresting system.

A28. The automated human personnel fall arresting system of claim A1, further comprising at least one proximity detector coupled to the controller and being mounted to one or more of the holonomic base platform and the boom arm.

A29. The automated human personnel fall arresting system of claim A28, wherein the controller is configured to limit or stop translational movement of the holonomic base platform in one or more of the two orthogonal directions based on signals received from the at least one proximity detector.

A30. The automated human personnel fall arresting system of claim A28, wherein the at least one proximity detector comprises one or more of a ranging sensor, a through beam sensor, and a camera.

A31. The automated human personnel fall arresting system of claim A28, further comprising an operator alert system coupled to the controller, the controller being configured to alert an operator at the operator harness of an object sensed by the at least one proximity detector.

A32. The automated human personnel fall arresting system of claim A1, wherein the controller is configured to automatically control a position of the holonomic base platform in the two orthogonal directions, relative to the operator harness, based on signals from the at least one sensor so that a tether support point of the boom arm is maintained, within a predetermined tolerance, above the operator harness.

B1. An automated human personnel fall arresting system comprising:

a holonomic base platform;

an extendable mast having a first end and a second end;

an arm member having a first end and a second end, the first end of the arm member being coupled to the second end of the extendable mast so that at least a portion of the arm member is movable relative to the holonomic base platform in two degrees-of-freedom, the first end of the extendable mast being coupled to the holonomic base so as to extend and retract the arm member relative to the holonomic base platform in an extension direction;

a tether supported by the arm member;

an operator harness coupled to the tether so as to be dependent from the arm member;

at least one sensor disposed on one or more of the extendable mast and the arm member, the at least one sensor being configured to sense movement of the arm member in the two degrees-of-freedom; and a controller mounted to the holonomic base platform and communicably coupled to the at least one sensor, the controller being configured to automatically control a position of the holonomic base platform in two orthogonal translational directions and one rotation direction controlled independently from translation, relative to the operator harness, based on signals from the at least one sensor.

B2. The automated human personnel fall arresting system of claim B1, wherein the arm member comprises a hollow shaft through which the tether passes.

B3. The automated human personnel fall arresting system of claim B2, further comprising a tether pay out system disposed on the holonomic base platform, wherein the tether extends from the tether payout system, through the arm member to the operator harness.

B4. The automated human personnel fall arresting system of claim B3, wherein the tether payout system includes a tensioning device configured to control a tension of the tether.

B5. The automated human personnel fall arresting system of claim B3, wherein the tether payout system includes a clutch configured to arrest movement of the tether upon a predetermined load being applied to the tether at the operator harness.

B6. The automated human personnel fall arresting system of claim B1, further comprising a tether pay out system disposed on the arm member, wherein the tether extends from the tether payout system to the operator harness.

B7. The automated human personnel fall arresting system of claim B6, wherein the tether payout system includes a tensioning device configured to control a tension of the tether.

B8. The automated human personnel fall arresting system of claim B7, wherein the tether payout system includes a clutch configured to arrest movement of the tether upon a predetermined load being applied to the tether at the operator harness.

B9. The automated human personnel fall arresting system of claim B1, wherein the extendable mast comprises a base member and a vertical extension member movably coupled to the base member so as to extend and retract relative to the base member.

B10. The automated human personnel fall arresting system of claim B9, further comprising a powered mast extension device configured to extend and retract the vertical extension member where the controller is configured to actuate the powered mast extension device based on operator input.

B11. The automated human personnel fall arresting system of claim B1, wherein the arm member is rotatably coupled to the second end of the extendable mast in both pitch and yaw.

B12. The automated human personnel fall arresting system of claim B11, wherein the at least one sensor is configured to sense a yaw angle of the arm member relative to the holonomic base platform and a pitch angle of the arm member relative to the holonomic base platform.

B13. The automated human personnel fall arresting system of claim B1, further comprising a compliant member having a first end coupled to the arm member and a second end coupled to the extendable mast, the compliant member being configured to decelerate movement of the arm member relative to the extendable mast.

B14. The automated human personnel fall arresting system of claim B1, wherein the arm member is fixed to the extendable mast.

B15. The automated human personnel fall arresting system of claim B14, wherein the arm member further comprises a tether articulation member mounted to a second end of the arm member, the tether articulation member being configured for movement in the two degrees-of-freedom, and the at least one sensor comprises a tether sensing system coupled to the tether articulation member, the tether sensing system being configured to sense an angle of the tether relative to one or more of the holonomic base platform and the arm member in the two degrees-of-freedom.

B16. The automated human personnel fall arresting system of claim B15, further comprising a compliant member having a first end coupled to the arm member and a second end coupled to the extendable mast, the compliant member being configured to decelerate movement of the arm member relative to the extendable mast.

B17. The automated human personnel fall arresting system of claim B1, further comprising one or more automated stabilization devices mounted to the holonomic base platform, the controller being configured to actuate the one or more automated stabilization devices based on the signals from the at least one sensor.

B18. The automated human personnel fall arresting system of claim B17, wherein the one or more automated stabilization devices includes at least one retractable outrigger.

B19. The automated human personnel fall arresting system of claim B18, wherein the at least one retractable outrigger includes an omnidirectional support.

B20. The automated human personnel fall arresting system of claim B17, wherein the one or more automated stabilization devices includes a counterweight movably mounted to the holonomic base platform.

B21. The automated human personnel fall arresting system of claim B1, wherein the holonomic base platform comprises a first base portion, a second base portion and an articulated joint rotatably coupling the first base portion to the second base portion.

B22. The automated human personnel fall arresting system of claim B1, further comprising an operator interface coupled to the controller, the operator interface being configured, through the controller, for manual operation of one or more of the holonomic base platform and the extendable mast at the operator harness.

B23. The automated human personnel fall arresting system of claim B22, wherein the operator interface is wirelessly coupled to the controller.

B24. The automated human personnel fall arresting system of claim B22, wherein the operator interface is wired to the controller.

B25. The automated human personnel fall arresting system of claim B22, wherein the operator interface comprises one or more of a smart phone, a tablet computer and a smart watch.

B26. The automated human personnel fall arresting system of claim B22, wherein the operator interface is configured to receive, from the controller, an operational status of the automated human personnel fall arresting system.

B27. The automated human personnel fall arresting system of claim B1, further comprising at least one proximity detector coupled to the controller and being mounted to one or more of the holonomic base platform, the arm member and the extendable mast.

B28. The automated human personnel fall arresting system of claim B27, wherein the controller is configured to limit or stop translational movement of the holonomic base platform in one or more of the two orthogonal directions based on signals received from the at least one proximity detector.

B29. The automated human personnel fall arresting system of claim B27, wherein the at least one proximity detector comprises one or more of a ranging sensor, a through beam sensor, and a camera.

B30. The automated human personnel fall arresting system of claim B27, further comprising an operator alert system coupled to the controller, the controller being configured to alert an operator at the operator harness of an object sensed by the at least one proximity detector.

B31. The automated human personnel fall arresting system of claim B1, wherein the controller is configured to automatically control a position of the holonomic base platform in the two orthogonal directions, relative to the operator harness, based on signals from the at least one sensor so that a tether support point of the arm member is maintained, within a predetermined tolerance, above the operator harness.

C1. An automated human personnel fall arresting method comprising:

sensing, with at least one sensor, movement of an arm member in two degrees-of-freedom relative to a holonomic base platform to which the arm member is mounted through an extendable mast; and automatically controlling a position of the holonomic base platform in two orthogonal translational directions and one rotation direction controlled independently from translation, relative to an operator harness tethered to the arm member, with a controller mounted to the holonomic base platform based on signals from the at least one sensor.

C2. The method of claim C1, wherein the position of the holonomic base platform is controlled relative to the operator harness so that a tether support point of the arm member is maintained, within a predetermined tolerance, above the operator harness.

C3. The method of claim C1, further comprising detecting a proximity of an obstruction in a path of one or more of the holonomic base platform or the arm member with at least one proximity detector.

C4. The method of claim C3, further comprising limiting or stopping translational movement of the holonomic base platform in one or more of the two orthogonal directions based on detection of the obstruction.

C5. The method of claim C3, further comprising alerting an operator at the operator harness of the obstruction.

C6. The method of claim C1, further comprising controlling, with a tensioning device, a tension of a tether tethering the operator harness to the arm member.

C7. The method of claim C1, further comprising arresting movement, with a clutch, of a tether tethering the operator harness to the arm member upon a predetermined load being applied to the tether at the operator harness.

C8. The method of claim C1, wherein sensing movement of the arm member in the two degrees-of-freedom comprises sensing a yaw angle of the arm member relative to the holonomic base platform and a pitch angle of the arm member relative to the holonomic base platform.

C9. The method of claim C1, wherein sensing movement of the arm member in the two degrees-of-freedom comprises sensing, in the two degrees-of-freedom, an angle of a tether relative to one or more of the holonomic base and the arm member, where the tether connects the operation harness to the arm member.

C10. The method of claim C1, further comprising decelerating movement of the arm member, with a compliant member, relative to the extendable mast coupling the arm member to the holonomic base platform.

C11. The method of claim C1, further comprising actuating one or more automated stabilization devices coupled to the holonomic base platform based on signals from the at least one sensor.

C12. The method of claim C1, further comprising, manually operating of one or more of the holonomic base platform and an elevation of the arm member, at the operator harness, through the controller and with an operator interface coupled to the controller.

In the figures, referred to above, solid lines, if any, connecting various elements and/or components may represent mechanical, electrical, fluid, optical, electromagnetic, wireless and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the drawings may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in the figures, may be combined in various ways without the need to include other features described in the figures, other drawing figures, and/or the accompanying disclosure, even though such combination or combinations are not explicitly illustrated herein. Similarly, additional features not limited to the examples presented, may be combined with some or all of the features shown and described herein.

In FIG. 9, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIG. 9 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the foregoing description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims, if any, are presented for illustrative purposes only and are not intended to limit the scope of the claimed subject matter to the specific examples provided in the present disclosure.

What is claimed is:

1. An automated human personnel fall arresting system comprising:

a holonomic base platform;

a boom arm movably mounted to and depending from the holonomic base platform, at least a portion of the boom arm being movable in three degrees-of-freedom relative to the holonomic base platform;

a tether supported by the boom arm;

an operator harness coupled to the tether so as to be dependent from the boom arm;

a plurality of sensors disposed on the boom arm and configured to sense movement of the portion of the boom arm in two degrees-of-freedom of the three degrees-of-freedom of the boom arm; and a controller mounted to the holonomic base platform and communicably coupled to the sensors, the controller being configured to automatically control a position of the holonomic base platform in two orthogonal translational directions and one rotation direction controlled independently from said translational directions, relative to the operator harness, based on signals from the sensors, and determine, based on the signals from the sensors, that the operator harness associated with an operator is following a curved path, and automatically control the holonomic base platform to rotate so that an arm member of the boom arm is maintained in a substantially orthogonal relationship with the curved path at which the operator harness is located.

2. The automated human personnel fall arresting system of claim 1, wherein the boom arm comprises an extendable mast coupled to the holonomic base at a first end of the extendable mast and the arm member movably coupled to a second end of the extendable mast at a first end of the arm member.

3. The automated human personnel fall arresting system of claim 2, wherein the extendable mast comprises a base member and a vertical extension member movably coupled to the base member so as to extend and retract relative to the base member.

4. The automated human personnel fall arresting system of claim 3, further comprising a powered mast extension device configured to extend and retract the vertical extension member where the controller is configured to actuate the powered mast extension device based on operator input.

5. The automated human personnel fall arresting system of claim 2, wherein the arm member is coupled to the second end of the extendable mast so as to be rotatable in both pitch and yaw relative to the holonomic base platform.

6. The automated human personnel fall arresting system of claim 5, wherein the sensors are configured to sense a yaw angle of the arm member relative to the holonomic base platform and a pitch angle of the arm member relative to the holonomic base platform.

7. The automated human personnel fall arresting system of claim 2, further comprising a compliant member having a first end coupled to the arm member and a second end coupled to the extendable mast, the compliant member being configured to decelerate movement of the arm member relative to the extendable mast.

8. The automated human personnel fall arresting system of claim 1, further comprising one or more automated stabilization devices mounted to the holonomic base platform, the controller being configured to actuate the one or more automated stabilization devices based on the signals from the sensor.

9. The automated human personnel fall arresting system of claim 1, wherein the holonomic base platform comprises a first base portion, a second base portion and an articulated joint rotatably coupling the first base portion to the second base portion.

10. The automated human personnel fall arresting system of claim 1, further comprising an operator interface coupled to the controller, the operator interface being configured, through the controller, for manual operation of one or more of the holonomic base platform and the boom arm at the operator harness.

11. An automated human personnel fall arresting system comprising:

a holonomic base platform;

a boom arm movably mounted to and depending from the holonomic base platform, at least a portion of the boom arm being movable in three degrees-of-freedom relative to the holonomic base platform;

a tether supported by the boom arm;

an operator harness coupled to the tether so as to be dependent from the boom arm;

a plurality of sensors disposed on the boom arm and configured to sense movement of the portion of the boom arm in two degrees-of-freedom of the three degrees-of-freedom of the boom arm;

a controller mounted to the holonomic base platform and communicably coupled to the sensors, the controller being configured to automatically control a position of the holonomic base platform in two orthogonal translational directions and one rotation direction controlled independently from said translational directions, relative to the operator harness, based on signals from the sensors; and an operator interface coupled to the controller, the operator interface being configured, through the controller, for manual operation of one or more of the holonomic base platform and the boom arm at the operator harness, wherein the operator interface is configured to receive, from the controller, an operational status of the automated human personnel fall arresting system.

12. The automated human personnel fall arresting system of claim 11, wherein the boom arm comprises an extendable mast coupled to the holonomic base at a first end of the extendable mast and an arm member coupled to a second end of the extendable mast at a first end of the arm member, the arm member being fixed to the extendable mast.

13. The automated human personnel fall arresting system of claim 12, wherein the boom arm further comprises a tether articulation member mounted to a second end of the arm member, the tether articulation member being configured for movement in the two degrees-of-freedom of the three degrees-of-freedom of the boom arm, and the sensors comprises a tether sensing system coupled to the tether articulation member, the tether sensing system being configured to sense an angle of the tether relative to one or more of the holonomic base platform and the arm member in the two degrees-of-freedom of the three degrees-of-freedom.

14. The automated human personnel fall arresting system of claim 12, further comprising a compliant member having a first end coupled to the arm member and a second end coupled to the extendable mast, the compliant member being configured to decelerate movement of the arm member relative to the extendable mast.

15. An automated human personnel fall arresting system comprising:

a holonomic base platform;

an extendable mast having a first end and a second end;

an arm member having a first end and a second end, the first end of the arm member being coupled to the second end of the extendable mast so that at least a portion of the arm member is movable relative to the holonomic base platform in two degrees-of-freedom, the first end of the extendable mast being coupled to the holonomic base platform so as to extend and retract the arm member relative to the holonomic base platform in an extension direction;

a tether supported by the arm member;

an operator harness coupled to the tether so as to be dependent from the arm member;

a plurality of sensors disposed on one or more of the extendable mast and the arm member, the sensors being configured to sense movement of the arm member in the two degrees-of-freedom; and a controller mounted to the holonomic base platform and communicably coupled to the sensors, the controller being configured to automatically control a position of the holonomic base platform in two orthogonal translational directions and one rotation direction controlled independently from said translational directions, relative to the operator harness, based on signals from the sensors, and determine, based on the signals from the sensors, that the operator harness associated with an operator is following a curved path, and automatically control the holonomic base platform to rotate so that an arm member of the boom arm is maintained in a substantially orthogonal relationship with the curved path at which the operator harness is located.

16. The automated human personnel fall arresting system of claim 15, further comprising at least one proximity detector coupled to the controller and being mounted to one or more of the holonomic base platform, the arm member and the extendable mast.

17. The automated human personnel fall arresting system of claim 15, wherein the controller is configured to automatically control a position of the holonomic base platform in the two orthogonal directions, relative to the operator harness, based on signals from the sensors so that a tether support point of the arm member is maintained, within a predetermined tolerance, above the operator harness.

18. An automated human personnel fall arresting method utilizing the automated human personnel fall arresting system of claim 2 comprising: sensing, with a plurality of sensors, movement of the arm member in two degrees-of-freedom relative to the holonomic base platform to which the arm member is mounted through the extendable mast; and automatically controlling the position of the holonomic base platform in two orthogonal translational directions and one rotation direction controlled independently from said translational directions, relative to the operator harness tethered to the arm member, with the controller mounted to the holonomic base platform based on signals from the sensors.

19. The method of claim 18, wherein the position of the holonomic base platform is controlled relative to the operator harness so that a tether support point of the arm member is maintained, within a predetermined tolerance, above the operator harness.

20. The method of claim 18, further comprising detecting a proximity of an obstruction in a path of one or more of the holonomic base platform or the arm member with at least one proximity detector.

* * * * *